United States Patent [19]

Williams et al.

[11] 4,238,251

[45] Dec. 9, 1980

[54] ZIRCONIUM ALLOY HEAT TREATMENT PROCESS AND PRODUCT

[75] Inventors: Cedric D. Williams, Wilmington, N.C.; Andrew W. Urquhart, Scotia; James L. Walker, Schenectady, both of N.Y.; Richard A. Proebstle; Timothy J. Black, both of San Jose, Calif.

[73] Assignee: General Electric Company, Schenectady, N.Y.

[21] Appl. No.: 852,906

[22] Filed: Nov. 18, 1977

Related U.S. Application Data

[63] Continuation of Ser. No. 552,794, Feb. 25, 1975, abandoned.

[51] Int. Cl.[2] ..... C21D 1/00

[52] U.S. Cl. ..... 148/133; 148/11.5 F; 148/32

[58] Field of Search ..... 148/133, 12.7, 11.5 F, 148/32, 32.5; 75/177

[56] References Cited

U.S. PATENT DOCUMENTS

| | | | |
|---|---|---|---|
| 2,894,866 | 7/1959 | Picklesimer | 148/11.5 |
| 3,287,111 | 11/1966 | Klepfo | 75/177 |
| 3,865,635 | 2/1975 | Hofvenstan et al. | 148/11.5 F |
| 3,963,534 | 6/1976 | Frenkel et al. | 148/11.5 F |

OTHER PUBLICATIONS

Fuel Element Fabrication w/ Special Emphasis on Cladding Materials, "Development of Zircaloy 4," J. N. Chirigos et al., Proceedings of a Symposium held in Vienna, May 10-13, 1960, vol. 1, Academic Press, 1961.

"The Effect of Heat Treatment on the Corrosion Resistance of Zircaloy-2 and Zircaloy-3," J. G. Goodwin, *Bettis Technical Review*, Jan., 1958, WAPD-BT-6, Bettis Plant, Pittsburg, Pa.

Cox, Journal of Nuclear Materials (28), 1968, pp. 1-47.

Cox, "Accelerated Oxidation of Zircaloy-2 in Supercritical Steam," AECL-4448, Apr., 1973.

Johnson et al., "A Study of Zirconium Alloy Corrosion Parameters in the Advanced Test Reactor," Paper presented Aug. 21-24, 1973, Portland, Oregon, ASTM & AIME.

Johnson, ASTM-STP458, 1969, pp. 271-285.

Kass, ASTM, STP368, 1964, pp. 3-27.

*Primary Examiner*—L. Dewayne Rutledge
*Assistant Examiner*—Peter K. Skiff
*Attorney, Agent, or Firm*—Leo I. MaLossi; James C. Davis, Jr.

[57] ABSTRACT

Zirconium-base alloy channels and fuel cladding tubes having unique resistance to accelerated pustular corrosion in the boiling water reactor environment are produced by a heat treatment causing segregation of intermetallic particulate precipitate phase in two dimensional arrays preferably located along grain boundaries and subgrain boundaries throughout the alloy body.

6 Claims, 4 Drawing Figures

ZIRCONIUM ALLOY HEAT TREATMENT PROCESS AND PRODUCT

This is a continuation, of application Ser. No. 552,794, filed Feb. 25, 1975, now abandoned and assigned to the assignee hereof.

The present invention relates generally to materials of construction of nuclear reactors and is more particularly concerned with a novel method of enhancing the ability of zirconium-base alloys to resist corrosive attack under boiling water reactor operating conditions, and with unique structural components produced through the use of that method.

CROSS REFERENCE

This invention is related to that disclosed and claimed in copending patent application Ser. No. 735,023 filed Oct. 22, 1976 as a continuation-in-part of patent application Ser. No. 552,795, filed Feb. 25, 1975, now abandoned and assigned to the assignee hereof which implements the present method in a zone heat treating process and apparatus based on the concept of traversing the length of a workpiece with a hot zone of fixed length in which the maximum temperature is maintained by regulation of power input automatically in response to fluctuations in infrared radiation from a portion of the workpiece axially spaced from the hot zone.

BACKGROUND OF THE INVENTION

Important requirements for materials used in boiling water nuclear reactor construction include low absorption for thermal neutrons, corrosion and stress-corrosion resistance and mechanical strength. Zirconium-base alloys sufficiently satisfy these requirements that they are widely used for such purposes, "Zircaloy-2" (containing about 1.5 percent tin, 0.15 percent iron, 0.1 percent chromium, 0.05 percent nickel and 0.1 percent oxygen) and "Zircaloy-4" (containing substantially no nickel and about 0.2 percent iron but otherwise similar to Zircaloy-2) being two of the important commercial alloys commonly finding such use. These alloys, however, are not nearly all that one would desire, particularly in respect to accelerated pustular corrosion which occurs under boiling water reactor normal operating conditions and results in spalling of thick oxides from channels and thickening of oxides on fuel rods. The spalling of oxide flakes leads in some instances to development of high radiation fields in the vicinity of control rod mechanisms where the flakes collect; and the presence of thick oxide layers reduces heat transfer efficiency and can result in local overheating of fuel cladding.

Efforts heretofore to solve this particular problem have to our knowledge met with no success, although the general subject of corrosion of such alloys has long been of active interest to experts in the field. Thus, in U.S. Pat. No. 3,005,706, it is proposed that from 0.03 to 1.0 percent of beryllium be added to zirconium alloys intended for use in conventional boilers, boiling water reactors and similar apparatus to enhance corrosion resistance to high temperature water. Similarly, in U.S. Pat. Nos. 3,261,682 and 3,150,972, cerium and/or yttrium and calcium, respectively, are proposed as zirconium alloy additions in like proportions for the same purpose. Accounts and reports of the long-term results of such compositional changes are sparse, however, and commercial zirconium alloys do not include these additional constituents.

SUMMARY OF THE INVENTION

This invention, which is predicated on our discovery and new concept to be described, provides an answer to the accelerated pustular corrosion problem in the form of a heat treatment process which at least approximately doubles the corrosion-limited lifetime of zirconium-base alloy boiling water reactor structural components. Moreover, this result can be obtained consistently, quickly and at relatively small additional cost, particularly through the use of the novel zone heat treating process and apparatus disclosed and claimed in the above-referenced copending patent application.

Our discovery is that in such alloys there is a strong correlation between a particular microstructural characteristic and resistance to accelerated pustular corrosion in boiling water reactor environments. This discovery is rooted in the heretofore unknown and unrecognized significance to corrosion in boiling water reactor environments of the microstructural differences between the heat-affected zone of a weld and the remainder of a zirconium-base alloy article. Thus, apparently because of heating associated with the welding operation, there is a redistribution of the intermetallic particulate phase [$Zr(Cr,Fe)_2$ in Zircaloy-4 and $Zr(Cr,Fe)_2$, $Zr_2(Ni,Fe)$ in Zircaloy-2] in a pattern which imparts the desired corrosion resistance characteristic to the metal. More specifically, the intermetallic particles are to a noticeable extent segregated in two dimensional arrays instead of being in the usual condition of generally uniform distribution and isolated and separated from each other.

Our concept is to use this discovery to greatly increase the service life of a zirconium-base alloy body by preparing it to intermediate or to substantially finished form as a boiling water reactor channel, or as a tube for nuclear fuel cladding, or as a fuel rod spacer for use in a reactor channel, and heating it to initiate transformation from alpha (hexagonal close packed) to beta (body centered cubic) phase, and finally to quenching it to a temperature substantially below the phase transformation temperature range. Segregation of precipitate particles is obtained to the desired extent by quenching after only a few seconds in the transformation temperature range down to 700° C.

The foregoing concept contrasts sharply with the teachings of the prior art which warns against heat treating of such alloys in the temperature range where the alpha phase is only partially transformed to beta because of detrimental effects on corrosion properties. We have found, however, that by cooling rapidly not only can this detrimental effect be avoided, but also corrosion properties in boiling water reactors can be significantly enhanced. In addition, physical properties in general and creep strength and ductility particularly are not adversely significantly affected by the heat treatment of this invention.

It is important in carrying out this invention to avoid processing operations subsequent to the foregoing heating and quenching steps such as hot and cold rolling and annealing which will result in elimination of the two dimensional arrays of precipitate particles throughout the alloy body. Rehomogenizing of those particles in any manner can lead to loss of the desired corrosion resistance characteristic.

This new concept of ours also differs importantly from the prior art notion of subjecting Zircaloy channels and tubes for use in boiling water reactors to heat treatment in the beta temperature range at an early stage of their fabrication so as to eliminate any undesirable dendritic or other segregate phase. Although quenching may have followed such heat treatment, any beneficial effects in the direction of the present invention were quickly lost in subsequent hot and cold working and annealing operations which were a necessary part of the fabrication schedule and different from the straightening, grit blasting, pickling and stress-relief annealing steps comprising the finishing (as distinguished from the fabrication) operations, which do not eliminate or diminish the foregoing beneficial effects.

In its method aspect, this invention comprises the steps of heating a zirconium alloy body to a temperature such that the alpha phase transforms at least partially to the beta phase, maintaining the body at that temperature until such phase transformation is initiated, then cooling the body to precipitate intermetallic phase dissolved during the heat step in the form of particles some of which are arrayed along alpha grain boundaries. Preferably, this cooling step involves quenching the body at a rate of at least about 20° C. per second to a temperature below about 700° C. While the body may be heated to a temperature which results in either partial or complete transformation to the beta phase, the former is preferable in the practice of this invention and the residence time at temperature may be as short as two or three seconds but is preferably of the order of about 3 to 30 seconds. Thus, while transformation of alpha to beta begins at about 825° C., a somewhat higher temperature, such as 870° C., is a desirable target in operations on a substantial scale for reasons both of process control and rate. Similarly, the cooling rate will preferably be somewhat greater than the minimum stated above, such as 200° C. per second. Cooling rates which are so great as to prevent precipitation of intermetallic phase should be avoided. While it is believed that cooling rates substantially greater than 400° C. per second may have such effect, this invention contemplates the use of cooling rates up to 800° C. per second and higher, and such are within the scope of the claims to this new process, provided that no substantial suppression of precipitation of the intermetallic phase results.

In its product or article aspect, the structural component of this invention is of zirconium-base alloy and has special utility in a boiling water reactor by virtue of its resistance to accelerated pustular corrosion. As indicated above, the alloy contains tin, iron and chromium and may additionally contain nickel, and it includes the zirconium-iron-chromium intermetallic compound, $Zr(Cr,Fe)_2$, and may also contain $Zr_2(Ni,Fe)$ in the form of a particulate precipitate. The microstructure of the article is characterized by segregation of a substantial proportion of the precipitate particles in two dimensional arrays distributed throughout the article. In a preferred embodiment of this invention, these arrays are located along alpha grain boundaries and sub-grain boundaries and 25 to 50 percent of the total precipitate phase is clustered in that way. It appears, however, that the new results and advantages of this invention can be reproducibly obtained when as little as one percent of the precipitate phase is so disposed in arrays at grain boundaries.

DESCRIPTION OF THE DRAWINGS

The novel features of this invention are illustrated in the drawings accompanying and forming a part of this specification, in which.

DETAILED DESCRIPTION OF THE INVENTION

Figure 1:
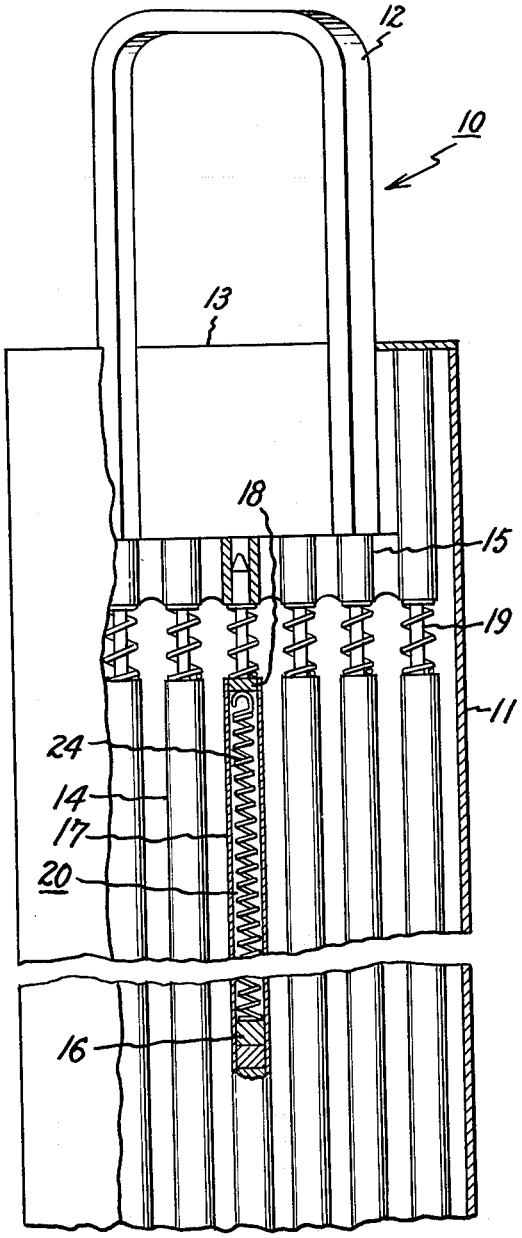
FIG. 1 is a partial cutaway sectional view of a nuclear reactor fuel assembly incorporating structural members embodying this invention in preferred form.

A primary application of this invention is in the fabrication of nuclear fuel assemblies such as that illustrated in the partial cutaway sectional view of FIG. 1. Assembly 10, as illustrated, is typical of the boiling water reactor fuel assembly design and consists of a tubular flow channel 11 of generally square cross section provided at its upper end with lifting bale 12 and at its lower end with a nose piece (not shown due to the lower portion of assembly 10 being omitted). The upper end of channel 11 is open at 13 and the lower end of the nose piece is provided with coolant flow openings. An array of fuel elements or rods 14 is enclosed in channel 11 and supported therein by means of upper end plate 15 and a lower end plate (not shown due to the lower portion being omitted), and rods 14 are maintained in spaced relation to each other by spacer grids (not shown) throuh which the rods extend located at intervals along the length of the assembly and secured to the rods 14. The liquid coolant ordinarily enters through the openings in the lower end of the nose piece, passes upwardly around fuel elements 14, and discharges at upper outlet 13 in a partially vaporized condition for boiling water reactors or in an unvaporized condition for pressurized reactors at an elevated temperature.

The nuclear fuel elements or rods 14 are sealed at their ends by means of end plugs 18 welded to the cladding 17, which may include studs 19 to facilitate the mounting of the fuel rod in the assembly. A void space or plenum 20 is provided at one end of the element to permit longitudinal expansion of the fuel material and accumulation of gases released from the fuel material. A nuclear fuel material retainer means 24 in the form of a helical member is positioned within space 20 to provide restraint against the axial movement of the pellet column, especially during handling and transportation of the fuel element.

The fuel element is designed to provide an excellent thermal contact between the cladding and the fuel material, a minimum of parasitic neutron absorption, and resistance to bowing and vibration which is occasionally caused by flow of the coolant at high velocity.

Channel 11 and fuel element or cladding 14 are produced in accordance with this invention by a method which includes in addition to the usual channel and tubeforming operations a final heat treatment at a temperature at which alpha phase will transform at least partially to beta phase, followed by a water spray quench. The rate at which the workpiece is heated to the phase transformation temperature range and the temperature level reached in that range are matters of choice, but both the minimum time in the range and the minimum cooling rate from the 825° C. threshold of the range are highly critical. Thus, the new advantages and results of this invention cannot be consistently obtained unless the particulate precipitate phase is altered as previously described, and we have found that such alteration cannot be accomplished to the extent necessary to increase by a factor of approximately two or more the corrosion-limited lifetime channels and cladding unless the time at temperature above the transus temperature is at least about three seconds and the cooling rate to about 700° C. is at least about 20° C. per second. Whether in commercial-scale practice the zone heat treating apparatus set forth in copending application Ser. No. 552,795 reference above is employed or other heat treating technique is used, a longer time such as 20 to 30 seconds and higher temperatures such as 850°-950° C. are preferred in carrying out this invention. Also, a greater cooling rate of the order of 200°-300° C. per second is preferred.

Time and temperature maxima are not critical within either the alpha--beta or the beta range. Heat treatment at temperatures resulting in complete transformation of the alpha phase to the beta phase (above approximately 965° C.) are therefore contemplated although not preferred since no particular advantage is to be gained by carrying the workpiece to a temperature above the two-phase temperature regime (approximately 825°-965° C.) and substantially more energy is required. For the same reason, the upper limit of temperature for this invention process may be fixed at about 1100° C. as a practical matter, although in theory temperatures up to the melting point temperature of about 1860° C can be used.

The present novel method and products are set forth in detail in the following illustrative, but not limiting, examples of the best practice of this invention in the production of channels and fuel cladding for use in boiling water nuclear reactors.

EXAMPLE I

Using the apparatus disclosed and claimed in copending application Ser. No. 552,795, a boiling water reactor channel about 14 feet long of generally square 5¾ inch cross section with rounded corners and 100-mil wall gauge thickness of Zircaloy-4 ASTM B352 Grade RA2 was zone heat treated following conventional fabrication including the shaping and joining two half sections together by welds running the full length of the channel. Thus, prior to usual finishing operations including final sizing and autoclaving, the channel was run axially at the rate of one-half inch per second through the heating and cooling stations. A zone three to four inches in length was thereby heated from room temperature to about 800° C. as the channel was moved through the electrical induction heating coil, reaching a maximum temperature of about 920° C. in a three-inch region between the coil and the cooling station. On entering the cooling station, the temperature of each successive portion of the channel was reduced from about 920° C. to about 700° C. within three seconds by means of an aerated water stream delivered against the outer annular surface of the channel. The quenching effect of the stream further reduced the channel temperature to about 500° C. within another six seconds.

The oxide coating formed on the channel as the heat treatment was conducted in air was removed by grit blasting after which the channel was sized to final internal dimensions and the ends were clipped to final length. Spacers were then attached to the outside of the channel to serve as control rod guides and then the channel was autoclaved in the customary manner. The channel was then ready to receive fuel rod spacers and loaded fuel rods.

Figure 2:
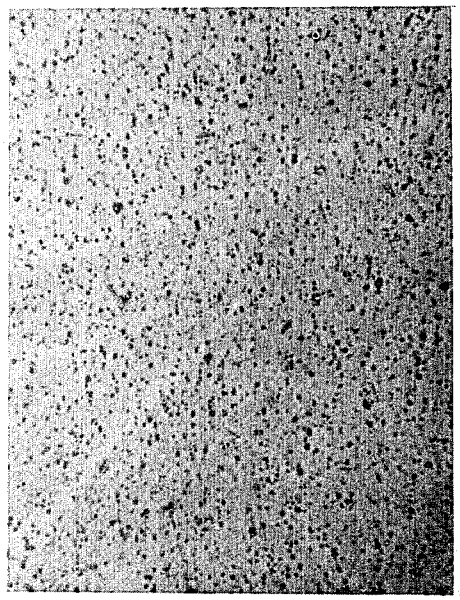
FIG. 2 is a photomicrograph (500×) of a conventional zirconium-base alloy, showing the distribution of particulate intermetallic phase.
Figure 3:
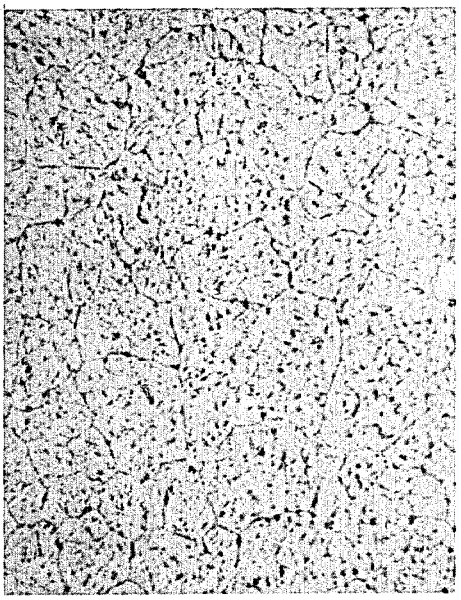
FIG. 3 is a photomicrograph at the same magnification of the FIG. 2 alloy following heat treatment in accordance with this invention.

Examination of the microstructure of the channel following autoclaving revealed that throughout the full length of the channel there had been a redistribution of the particulate precipitate phase. Thus, as shown in FIG. 2, the particles of the intermetallic compound, $Zr(Cr,Fe)_2$ were separated and isolated and more or less evenly distributed prior to the heat treatment. Following heat treatment and the finishing operations described above, the microstructure was characterized by marked development of microscopic segregation of the particulate material, particles being clustered in two dimensional arrays along the alpha grain boundaries. FIG. 3 illustrates this altered condition, which prevailed throughout the entire channel and corresponds to the microstructure of a typical heat-affected zone of a weld having unique resistance to accelerated pustular corrosion in boiling water reactor environments as set out above.

EXAMPLE II

An operation was carried out as described in Example I with substantially the same results in terms of observed microstructural characteristics, the heat treatment schedule differing in that the channel was heated from room temperature to 843° C. at the average rate of 195° C. per second. The 843° C. temperature was maintained for 30 seconds, whereupon the channel was cooled at the average rate of 55° per second to 538° C. Throughout the elevated temperature portion of the channel travel course through the heating and cooling stations, the channel was maintained under an atmosphere of argon--helium, the stations being enclosed and the pressure of inert gas being maintained above atmospheric pressure both within and outside the channel.

Because the heat treatment was conducted under an inert atmosphere, the channel did not require grit blasting prior to final sizing and autoclaving.

EXAMPLE III

Fuel cladding of commercial-grade Zircaloy-4 may be fabricated through conventional practice and then subjected to heat treatment carried out in the manner described in Example I. In such operation, heating may be at the rate of 60° per second from 750° C. to 860° C. and the cladding may be maintained between 860° and 930° C. for three seconds, whereupon it is water-quenched at the rate of almost 400° C. per second to 700° C. by an aerated water spray. Cladding temperature may be further reduced as the cladding is moved downwardly below the cooling station spray nozzles, reaching about 500° C. within less than six additional seconds. The results obtained in terms of the microstructure would be those described in Example I and shown in FIGS. 2 and 3.

EXAMPLE IV

Figure 4:
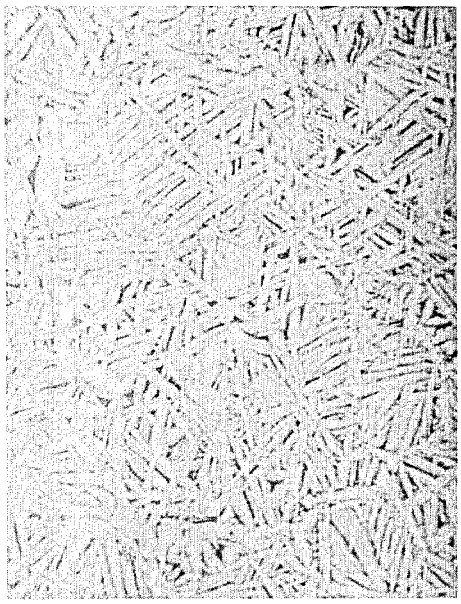
FIG. 4 is a photomicrograph like that of FIGS. 2 and 3 of the same alloy after an alternative heat treatment of this invention.

In another experiment like that of Example I, the channel may be heated to a maximum temperature of 1000° C. for five seconds and the water spray quenched at the rate of 400° per second to 700° C. and at the rate of 300° C. per second to 500° C. The resulting microstructure would be as shown in FIG. 4, in which the characteristic Widmanstäten plates structure appear and the large proportion of the intermetallic precipitate phase particles are clustered in the grain boundaries and the sub-grain boundaries.

Throughout this specification and the appended claims where ratios or proportions are stated, reference is to the weight basis unless otherwise specified.

Those skilled in the art will understand from the above description of this invention in general and specific terms that the invention is applicable to zirconium-base alloy strip material as well as to channels and other structural components fabricated therefrom. The important point is that hot or cold working and annealing operations which tend to rehomogenize the microstructural segregation produced by the process of this invention should be avoided in subsequent fabrication operations. Channels can, however, be fabricated from strip processed in accordance with this invention method without the necessity for such hot or cold rolling and annealing steps and without causing such rehomogenization.

What we claim as new and desire to secure by Letters Patent of the United States is:

1. As an article of manufacture, a zirconium-base alloy structural component produced by the method including, in addition to hot and cold working and annealing steps, the steps of heating said structural component to 825° C. to 1100° C., maintaining said structural component at said temperature for at least about 3 seconds to initiate alpha to beta transformation, cooling said structural component to about 700° C. at a rate of at least about 20° C. per second to precipitate intermetallic phase material dissolved during the heating step in two dimensional arrays in an amount effective to at least double the corrosion-limited lifetime of said structural component and retaining substantially all said two dimensional arrays during any subsequent processing steps executed through and including installing said structural component in a boiling water reactor.

2. The article of claim 1 which is a channel and in which the intermetallic precipitate phase is $Zr(Cr,Fe)_2$.

3. The article of claim 1 in which the intermetallic precipitate phases are $Zr(Cr,Fe)_2$, $Zr_2(Ni,Fe)$.

4. In the method of producing a boiling water reactor structural component of a zirconium-base alloy including hot and cold working and annealing steps comprising a fabrication schedule, the combination of the steps of heating the structural component to 825° C. to 1100° C., maintaining the structural component at said temperature for at least about 3 seconds to initiate alpha to beta transformation, cooling the structural component to about 700° C. at a rate of at least about 20° C. per second to precipitate intermetallic phase material dissolved during the heating step in two dimensional arrays in an amount effective to at least double the corrosion-limited lifetime of said structural component and retaining substantially all said two dimensional arrays during any subsequent processing steps executed through and including installing said structural component in a boiling water reactor.

5. The method of claim 4 in which the structural component is cooled to below 300° C. at the rate of approximately 250° C. per second.

6. The method of claim 4 in which from 25 percent to 50 percent of the total intermetallic particles are precipitated in two dimensional arrays located at alpha grain and sub-grain boundaries throughout the structural component.

* * * * *